US007562480B2

(12) United States Patent
Mauch et al.

(10) Patent No.: US 7,562,480 B2
(45) Date of Patent: Jul. 21, 2009

(54) FIREARMS PROTECTED FROM UNAUTHORIZED USE

(75) Inventors: Ernst Mauch, Dunningen (DE); Michael Schumacher, Fluorn-Winzeln (DE)

(73) Assignee: Heckler & Koch, GmbH (DE)

( * ) Notice: Subject to any disclaimer, the term of this patent is extended or adjusted under 35 U.S.C. 154(b) by 0 days.

(21) Appl. No.: 11/617,311

(22) Filed: Dec. 28, 2006

(65) Prior Publication Data

US 2008/0000130 A1 Jan. 3, 2008

Related U.S. Application Data

(60) Division of application No. 10/763,374, filed on Jan. 23, 2004, now Pat. No. 7,155,855, which is a continuation-in-part of application No. PCT/EP02/08306, filed on Jul. 25, 2002.

(30) Foreign Application Priority Data

Jul. 25, 2001 (DE) ..... 101 36 287

(51) Int. Cl.
*F41A 17/00* (2006.01)
*F41A 19/00* (2006.01)

(52) U.S. Cl. ..... 42/70.01; 42/70.02; 42/70.06; 42/70.08; 42/84

(58) Field of Classification Search ..... 42/70.01, 42/70.06, 70.08, 70.11, 84
See application file for complete search history.

(56) References Cited

U.S. PATENT DOCUMENTS 3,939,679 A * 2/1976 Barker et al. ..... 70/277
4,105,885 A * 8/1978 Orenstein ..... 200/43.05
4,440,063 A * 4/1984 Zangrando ..... 89/135
4,467,545 A * 8/1984 Shaw, Jr. ..... 42/70.01
4,488,370 A * 12/1984 Lemelson ..... 42/70.01
4,682,435 A * 7/1987 Heltzel ..... 42/70.01
5,016,376 A * 5/1991 Pugh ..... 42/70.11
5,022,175 A * 6/1991 Oncke et al. ..... 42/70.11
5,062,232 A * 11/1991 Eppler ..... 42/70.11
5,074,189 A * 12/1991 Kurtz ..... 89/135
5,303,495 A * 4/1994 Harthcock ..... 42/84

(Continued)

FOREIGN PATENT DOCUMENTS

DE 3446019 6/1986

(Continued)

OTHER PUBLICATIONS

English Translation of International Preliminary Examination Report for International Patent Application No. PCT/EP02/08306, 11 pages.

(Continued)

*Primary Examiner*—Stephen M Johnson
*Assistant Examiner*—Daniel J Troy
(74) *Attorney, Agent, or Firm*—Hanley, Flight, & Zimmerman, LLC

(57) ABSTRACT

Firearms protected from unauthorized use are disclosed. A disclosed firearm comprises a housing having a handle; a safety located in the housing to selectively prevent firing; and a module removably attachable to the handle and containing an electronic identification device to identify an authorized user. The electronic identification device controls the safety to prevent firing by unauthorized persons and to permit firing by the authorized user.

28 Claims, 5 Drawing Sheets

U.S. PATENT DOCUMENTS

| | | | | | |
|---|---|---|---|---|---|
| 5,448,847 | A * | 9/1995 | Teetzel | 42/70.11 |
| 5,459,957 | A * | 10/1995 | Winer | 42/70.11 |
| 5,546,690 | A * | 8/1996 | Ciluffo | 42/70.11 |
| 5,560,135 | A * | 10/1996 | Ciluffo | 42/70.07 |
| 5,570,528 | A * | 11/1996 | Teetzel | 42/70.11 |
| 5,603,179 | A * | 2/1997 | Adams | 42/70.08 |
| 5,625,972 | A * | 5/1997 | King et al. | 42/84 |
| 5,636,464 | A * | 6/1997 | Ciluffo | 42/70.11 |
| 5,675,925 | A * | 10/1997 | Wurger | 42/70.11 |
| 5,713,150 | A * | 2/1998 | Ealovega | 42/84 |
| 5,896,691 | A * | 4/1999 | Kaminski et al. | 42/70.11 |
| 5,915,936 | A * | 6/1999 | Brentzel | 42/70.11 |
| 5,924,232 | A * | 7/1999 | Rhoden et al. | 42/70.11 |
| 5,946,840 | A * | 9/1999 | Mickel | 42/70.11 |
| 6,185,852 | B1 * | 2/2001 | Whalen et al. | 42/70.11 |
| 6,220,719 | B1 * | 4/2001 | Vetorino et al. | 362/192 |
| 6,321,478 | B1 * | 11/2001 | Klebes | 42/84 |
| 6,343,140 | B1 * | 1/2002 | Brooks | 382/115 |
| 6,351,906 | B1 * | 3/2002 | Honig et al. | 42/70.11 |
| 6,357,156 | B1 * | 3/2002 | Klebes et al. | 42/70.11 |
| 6,363,647 | B2 * | 4/2002 | Kaminski | 42/70.11 |
| 6,412,207 | B1 * | 7/2002 | Crye et al. | 42/70.06 |
| 6,477,801 | B1 * | 11/2002 | O'dwyer | 42/70.11 |
| 6,481,140 | B1 * | 11/2002 | Marshall | 42/70.11 |
| 6,678,984 | B1 * | 1/2004 | Rapp et al. | 42/70.11 |
| 6,735,897 | B1 * | 5/2004 | Schmitter et al. | 42/70.01 |
| 7,155,855 | B2 * | 1/2007 | Mauch et al. | 42/70.01 |
| 7,168,198 | B2 * | 1/2007 | Newkirk et al. | 42/70.11 |
| 7,180,425 | B2 * | 2/2007 | Yuasa | 340/669 |
| 2002/0174585 | A1 * | 11/2002 | Fluhr et al. | 42/70.01 |
| 2003/0070343 | A1 * | 4/2003 | Glock | 42/70.11 |
| 2005/0000139 | A1 * | 1/2005 | Mauch et al. | 42/70.01 |

FOREIGN PATENT DOCUMENTS

| | | |
|---|---|---|
| DE | OS 198 05 306 | 8/1999 |
| DE | OS 198 31 690 | 9/1999 |
| JP | 0040209300AA | 4/1992 |
| JP | 0100258178AA | 9/1998 |
| WO | WO 98/55817 A | 12/1998 |
| WO | WO 00/26848 A1 | 5/2000 |

OTHER PUBLICATIONS

International Search Report for International Application No. PCT/EP02/08306, 6 pages.

* cited by examiner

FIREARMS PROTECTED FROM UNAUTHORIZED USE

RELATED APPLICATION

This is a Divisional of U.S. application Ser. No. 10/763,374, filed Jan. 23, 2004, now U.S. Pat. No. 7,155,855, issued Jan. 2, 2007, which is a Continuation-In-Part of International Patent Application Serial No. PCT/EP02/08306, which was filed on Jul. 25, 2002, and has a priority date of Jul. 25, 2001.

FIELD OF THE DISCLOSURE

This disclosure relates generally to firearms, and, more particularly, to firearms protected from unauthorized use.

BACKGROUND

The clamor for precautions preventing the use of small firearms by unauthorized persons is increasing, in particular with respect to handguns.

One can subdivide small firearms into the following groups:

Weapons Used in War:

Weapons used in war must be inexpensive and absolutely reliable. A safety, as simple as it might be, slows down the use of the weapon. Further, every soldier must be able to use every small arm he has been trained to use. For example, if his weapon is defective and he has access to the weapon of a fallen comrade, he must be able to use the comrade's weapon. Therefore, identifying/authorization devices which restrict usage of a weapon to a particular soldier are inappropriate as a rule.

Weapons Used in Civilian Life:

Military, police, and even the employees of civilian security or personal protection companies may use weapons that, upon changing of a guard or a shift can take a certain amount of time to perform an identification routine to authorize the new personnel to use a weapon. During the watch, the mission, etc., the weapon should be ready to fire as quickly as possible. However, in the case of loss, the weapon preferably becomes immediately unusable. One or more specified persons must be authorized for use. The authorization must, however, be revocable.

Sporting Weapons:

Sporting weapons can definitely require time for a user identification/authorization process that determines if the user is authorized to use the weapon. The weapon should, however, also be usable by a person other than the identified person if desired, for example, in the case of a loaned weapon. If a weapon is set aside, it does not have to become unusable immediately.

Private Defense Weapons:

Limiting authorization to identified users should be performed without entering code numbers or the like, since the user may forget the code numbers after years of not using the weapon. The batteries for an electric/electronic identification/authorization device also pose a problem, since they can overage. As a rule it will suffice if only one user of the weapon is identifiable as an authorized user.

Collector's Weapons:

Such weapons are usually kept stationary. Therefore, it is sufficient in such cases to keep the weapon stored in a safe, in a secured armory, etc. Hunting weapons that are used only rarely also fall into this category. However, frequently used hunting weapons fall under the "weapons used in civilian life" category or the "sporting weapons" category, depending on the type of use.

As far as possible, weapons manufacturers attempt to manufacture one weapon, with slight modifications, for as many of the above categories of use as possible. While large caliber small arms of the same basic design can find application in all types of use; the requirements for the individual types of use are sometimes contradictory.

Fingerprint or handprint scanning systems for identifying/authorizing gun users have already been proposed. However, these systems are unsuitable in cases where, for example, the user is wearing a glove or a bandage on his hand, or when the hand has been soiled with paint, oil or mud.

Additionally the provision of pushbuttons or the like for entering a personal identification number for enabling usage of a weapon has been proposed. However this approach requires a special construction of the weapon in order to provide storage space for the pushbuttons.

Voice and speech detection devices to identify/authorize a user of a weapon have also been proposed. These systems do not given thought to the fact that high-pitched, excited or whispering voices sound differently than voices or words that were entered calmly beforehand in the weapons shop as a reference sample.

The following publications are known: U.S. Pat. Nos. 5,459,957; 5,546,690; 5,560,135; 5,570,528; 5,636,464; 5,924,232; Japanese patent document JP 0100258178AA; U.S. Pat. Nos. 5,603,179; 5,303,495; 4,682,435; 4,467,545; 5,022,175; Japanese patent document JP 0040109300AA; German patent document DE-OS 198 31 690 and German patent document DE-OS 198 05 306.

DETAILED DESCRIPTION

Figure 1:
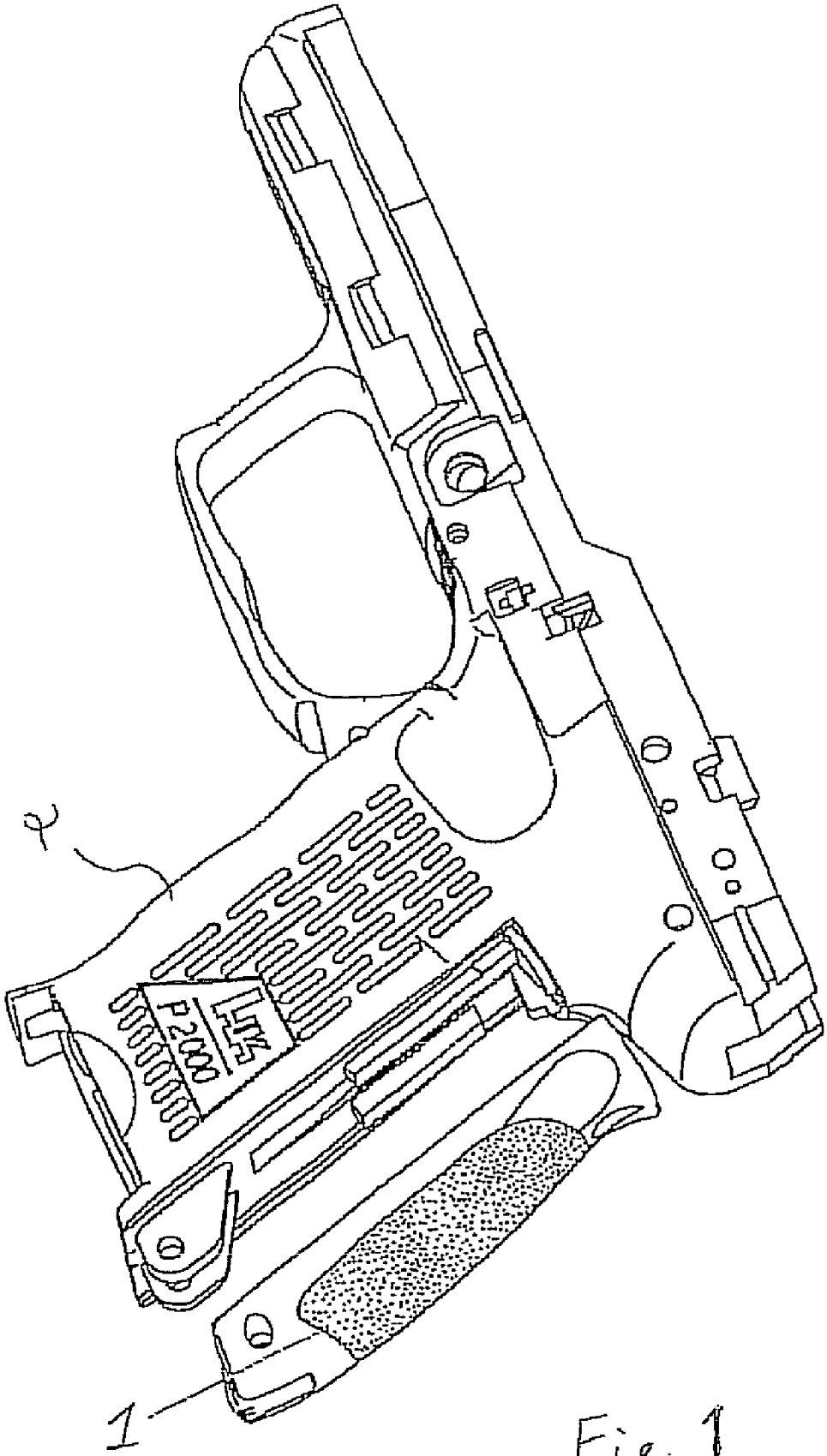
FIG. 1 is a left, rear perspective view of an example automatic firearm.
Figure 2:
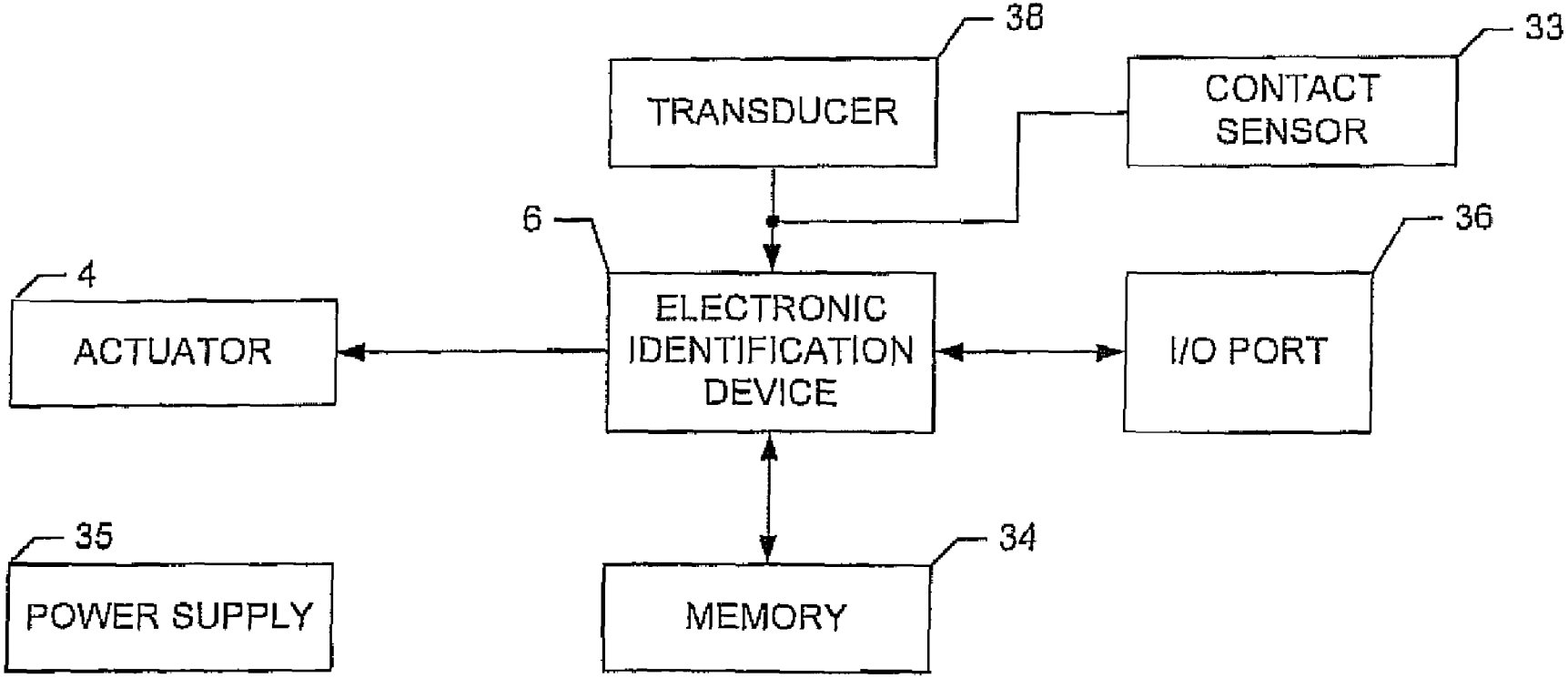
FIG. 2 is a block diagram of an example identification module.

The example pistol of FIG. 1 has a module 1 which may be inserted into the rear of the handle 2. A block diagram illustrating an example module 1 is shown in FIG. 2. The module 1 has a safety or an actuator 4 for controlling the state of a safety of the pistol. The module 1 may also have an electronic identification device 6 such as a voice identification device, a speech identification device, and/or a magazine identification device. The voice identification device, the speech identification device, and/or the magazine identification device, if present, may control the state of the safety via the actuator 4. For example, the safety 1 may only enter the "ready to fire" state when the voice identification device, the speech identification device, and/or the magazine identification device outputs a signal indicating that the user of the weapon is an authorized user. This signal may cause the actuator 4 to drive the safety by, for example, unblocking the firing pin, the trigger, or another portion of the trigger mechanism.

Figure 3:
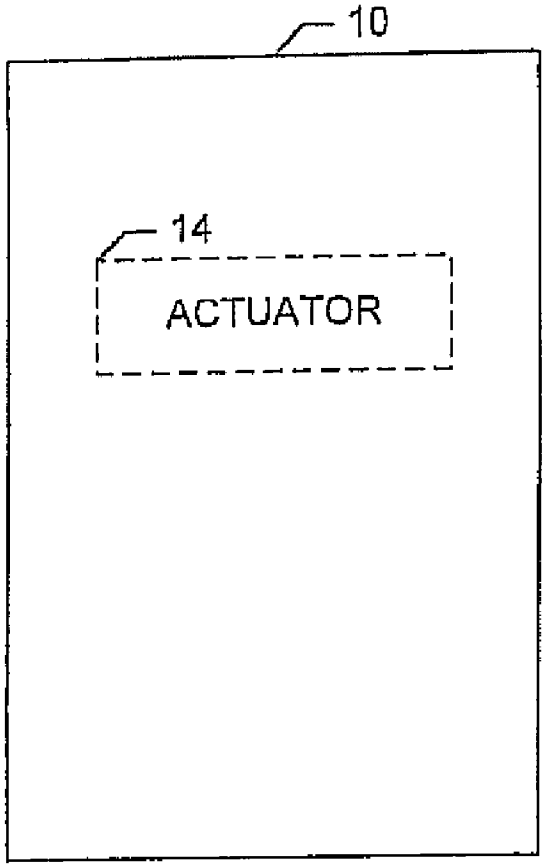
FIG. 3 is a block diagram of an example blank module.

The module 1 may alternatively be a blank module 10 which, after being attached to the pistol either keeps the weapon's safety permanently on or permanently off until the module 10 is removed. In other words, rather than requiring the user to identify himself/herself by entering data (e.g., a voice command) into the module 10, the blank module 10 could be configured to not require such data. In a case where the blank module 10 places the safety in a ready to fire state, possession of the blank module 10 (i.e., connection of the blank module 1 to the handle 2) would serve as authorization to fire the weapon. In other words, as shown in FIG. 3, the blank module 10 would not have an electronic identification device and, thus, would not serve to uniquely identify authorized users, but would instead have a mechanical actuator 14 for holding the safety in a released state whenever the module 10 is attached to the handle 2. Of course, a blank module 10 designed to maintain the safety in the prevent firing condition, would not include the actuator 14.

In the illustrated example, the weapon is powered by relative movement between two parts. In some examples, the moving parts are a magazine 20 and a magnetic or electrical device located in the magazine shaft 22 such that, inserting the magazine 20 into the magazine shaft 22 of the pistol generates a current surge, which supplies the energy for operation of the identification device 6 and the actuator 4.

Figure 4:
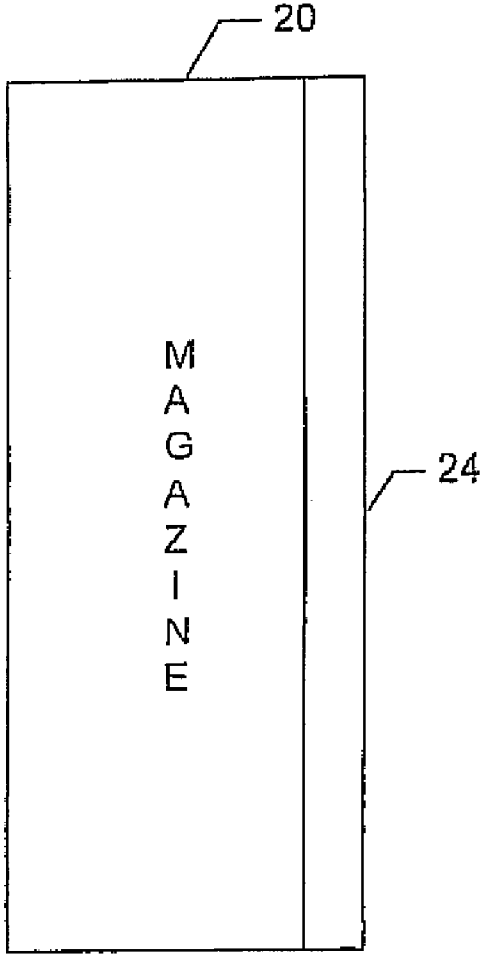
FIG. 4 is a schematic view of an example magazine.
Figure 5:
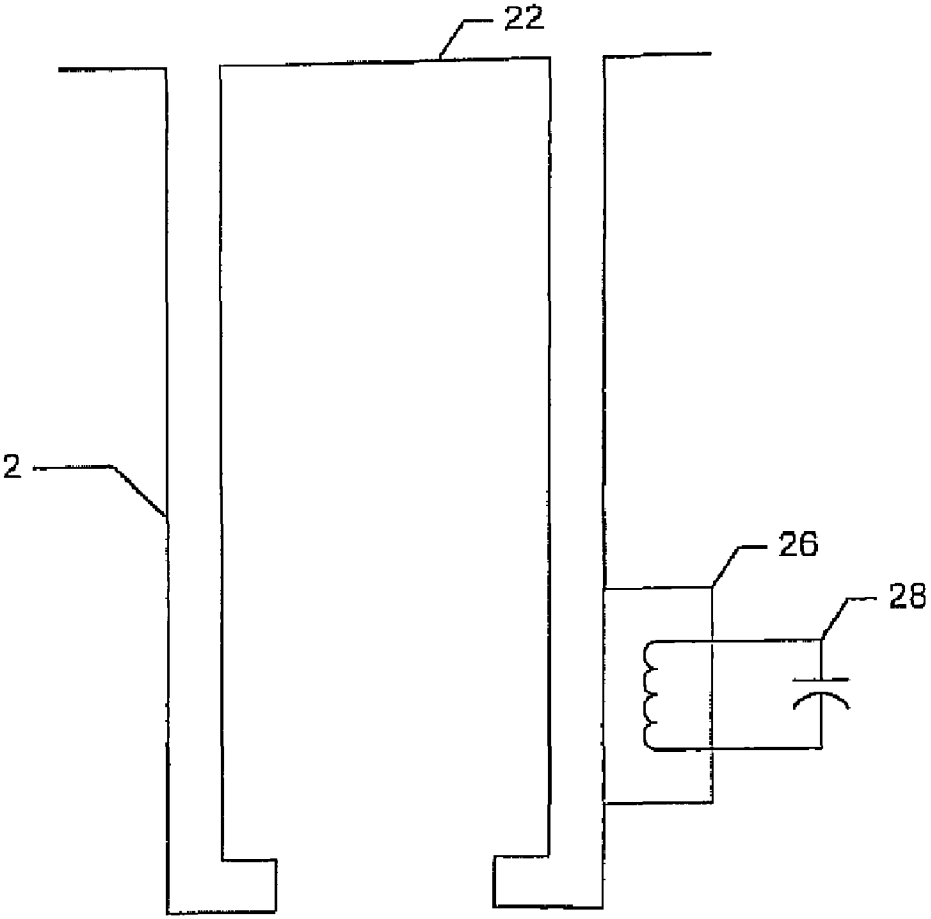
FIG. 5 is a cross-sectional view of an example magazine shaft of the firearm of FIG. 1.

As shown in FIGS. 4 and 5, a magnet 24 may be carried by the magazine 20 and a conductor 26 such as an inductor may be positioned adjacent to the travel path of the magnet 24 such that, upon insertion of the magazine 20 into the shaft 22, current is induced in the conductor 26 which is delivered to an accumulator 28.

Figure 6:
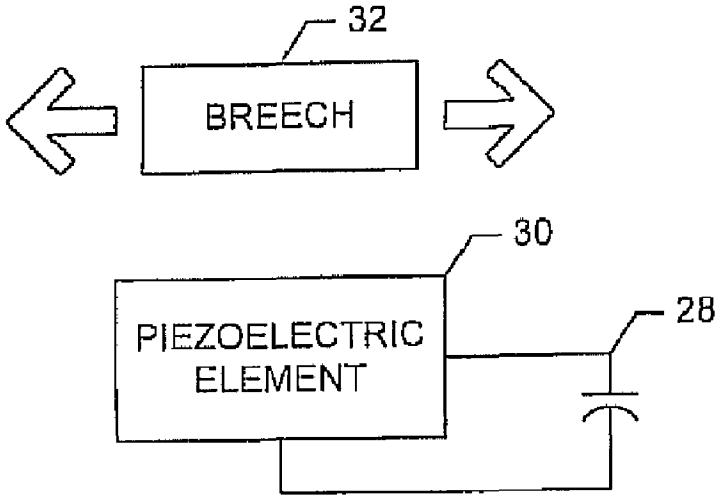
FIG. 6 is a schematic illustration of an example breech and piezoelectric device.

In other examples, a piezoelectric quartz crystal 30 such as that shown in FIG. 6 is present which produces a current surge in response to the recoil of the breech 32 after each shot. Under either of the above approaches, the pistol does not require a battery or the like.

As shown in FIG. 2, the module 1 may be provided with the actuator 4, the electronic identification device 6 and a power supply 35. The actuator 4 may be implemented by, for example, a magnetically driven pin. The electronic identification device 6 may be implemented by a logic circuit such as a microprocessor, an ASIC, or a hardwired circuit. The power supply 35 may be implemented by a conventional battery, but is preferably implemented by a capacitor 28 in combination with the conductor 26, or a piezoelectric crystal 30 described above.

As explained in further detail below, the module 1 may be further provided with a memory 34 to store data useful in identifying authorized users, an input port 36 for receiving data (e.g., data identifying authorized users) and/or instructions, and/or one or more transducers 38 to collect user identification data such as voice commands or iris scans. The memory 34 can be implemented by, for example, flash memory. The input port 56 may be, for example, a universal serial bus (USB). The transducers may be, for example, a microphone or an optical sensor.

In the illustrated example, a contact sensor 33 (see FIG. 2) is arranged on the rear of the module 1. The contact sensor 33 may, for example, be a spring-biased, push-button switch that causes deactivation of the actuator 4 when released by, for example, dropping the weapon as explained further below.

Although not shown in the drawings, the module 1 may also extend further up then the module 1 shown in FIG. 1 and have an optical sensor 38 for iris recognition on the upper rear.

From the foregoing, persons of ordinary skill in the art will appreciate that firearms having an electronic identification/authorization device 6 have been disclosed. In the illustrated example, the device 6 for identifying/authorizing the shooter is located inside a module 1 which comprises a portion of the handle 2 of the firearm.

The module 1 with the identification device 6 can, if desired, be exchanged for another module 1 having a different identification device 6 and/or different identification data (e.g., a module that identifies one or more authorized users which may be different from the authorized user(s) identified by the first module) or with no identification device (e.g., a blank module 10 as explained above).

The power supply 35 for the identification device 6 of the module 1 and, if desired, for a magnetic drive 4 for operating the safety may be an accumulator such as a conventional storage battery or capacitor. If a capacitor is employed in this role, it is not a matter of actually storing current over the longest possible period of time, but rather it is a matter of reliably making the capacitor available over a very long period of time (e.g., decades) for the storage of current when needed.

In a preferred example, long-term batteries or long-term accumulators are not used. Instead, one or more short term storage devices which may be charged by the relative motion of two parts of the weapon are used. These moving parts may be, for example, a magnet 24 whose relative motion induces a current in a conductor 26. This current may then be stored for only a short time, but it suffices to supply the electronic identification/authorization device 6 or safety actuator device 4 with sufficient current for the conventional time period of use. A weapon employing this type of storage device has the advantage that it can remain unused for years and nevertheless can be used immediately when needed, (for example, as a means of home defense), since the relatively movable parts will supply the weapon with the required electric current immediately prior to operation.

These relatively movable parts are preferably the magazine 20 and a conductor 26 located adjacent to the handle 2 or magazine shaft 22 (which is preferably located in the handle 2) as shown in FIGS. 4 and 5. While the presence of the current generating components may increase the force necessary to insert the magazine 20 into the magazine shaft 22, this additional expenditure of force required by the presence of the current generating components is irrelevant since, in order to ensure that it reliably locks into place, the magazine 20 is typically pushed into the magazine shaft 22 with a relatively powerful jolt. Moreover, the weapon is made even more secure during storage, because the user is compelled to store the magazine 20 away from the weapon. In particular, because the insertion of the magazine 20 is necessary for operation of the weapon (i.e., to supply the power required to activate the identification/authorization device 6 and, thus, to release the safety), the magazine 20, if it were to remain in the weapon, would have to be first removed from the weapon prior to operation, and then reinserted. Therefore, a user is likely to store the weapon without the magazine 20 in the shaft 22 or, if the magazine 20 is left in the weapon, the weapon will not be usable to fire until the magazine 20 is withdrawn and reinserted as explained above. Further, not only does the first loading of the automatic pistol generate the necessary current, but the accumulator 28 is also further charged or recharged with each reloading operation. This design promotes the safety of the weapon, since the weapon is not stored with a bullet in the cartridge chamber, but rather in each case must be loaded prior to the first shot, provided the accumulator 28 is not already charged.

The relatively movable parts may alternatively be advantageously formed by the handle 2 on the one hand and by the breech 32 or by parts that are movable together with the breech 32 on the other hand.

Relatively moving parts may also be, for example, a movable front end or a cartridge cylinder whose rotation activates the identification device during the first cocking.

The above-mentioned accumulator 28 can also be provided only as an additional device for cases of emergency, together with a conventional battery or accumulator for normal operation. When such a firearm is used at, for example, a security company, the conventional battery or accumulator may be charged before each shift.

In another preferred example, a piezoelectric element 30, (for example, a quartz crystal), is provided somewhere on the weapon (e.g., preferably in the handle 2) to convert shock loads that occur, for example, when a shot is fired into electric voltage and ultimately into electric current which is conducted to the accumulator 28. To this end, the piezoelectric quartz crystal 30 may be impinged by the breech 32, by the recoil spring, by the combustion gases or by a gas piston propelled by the breech 32, recoil spring or combustion gases when a shot is fired. Irrespective of the precise implementation mode selected, it is preferable that the recoil energy to which the quartz crystal 30 is exposed during shooting is used to cause the crystal 30 to generate the charging current.

In some examples, an electronically readable identification code is arranged on the magazine 20 such that the code is read from the weapon upon insertion of the module 1 into the handle 2. This technique is particularly advantageous for weapons of the "used in civilian life" category. For example, under such an approach, each employee of a factory security company is issued a magazine 20 which bears a code identifying the corresponding employee. Prior to the shift, the weapons (e.g., the modules 1 of the weapons) to be used in the shift are programmed with the codes of the employees who are assigned to the shift. Now when a magazine 20 is inserted into one of the weapons, the safety of the weapon will only release if the magazine 20 bears the code of an employee assigned to the shift. This identification code on the magazine 20 can also be stored in the electronics (e.g., in the module 1) of the weapon when the magazine 20 is inserted into the shaft 22, so that, if the magazine code 20 is uniquely associated with a specific employee, one can later determine which employee carried the weapon (i.e., which magazine 20 was inserted into the weapon) by reading the memory of the weapon.

Figure 7:
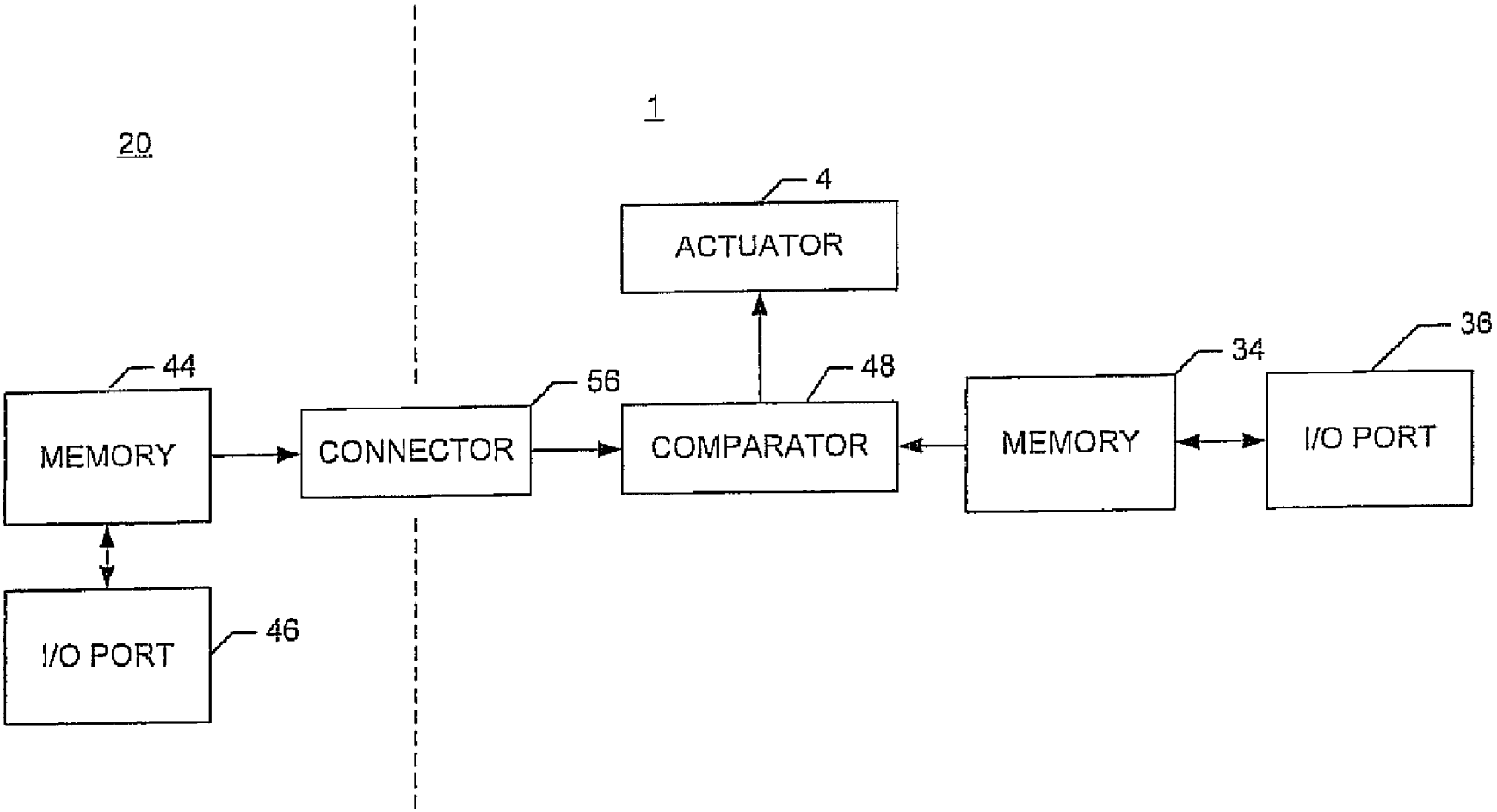
FIG. 7 is a block diagram of an example magazine and an example magazine identification module.

An example magazine identification system is shown in FIG. 7. In the illustrated example, the system includes a memory 44 storing the magazine identification code and an input port 46 for programming the memory 44. However, the input port 46 may be eliminated and the memory 44 may be replaced with another readable code such as an RF tag or a bar code.

In the illustrated system, the module 1 is simplified to include only an actuator 4 for driving the safety, a power supply 35 to power the module 1 (and possibly the electronics of the magazine 20), a memory 34, an input port 36, and a comparator 48. The actuator 4, the power supply 35, the memory 34 and the input port 36 may be implemented as explained above. The comparator 48 is structured to compare the magazine identification code from the memory 44 to one or more user authorization codes stored in the memory 34. If a match occurs, the comparator 48 outputs a signal to actuate the safety actuator 4. If no match occurs, the actuator 4 is not actuated.

As shown in FIG. 7, a connector 56 may be provided to automatically couple the electronics of the magazine 20 and the module 1 when the magazine 20 is inserted into the shaft 22.

This type of magazine identification system is advantageous in that the identification code can be read from the memory 44 with absolute accuracy (not just with relative accuracy), as in the case of a fingerprint identification system or the like. Under no circumstances is there any remaining uncertainty.

The magazine identification approach can also be coupled with one or more other methods of identification (e.g., a secondary identification method such as a voice detection or iris scanning method. Further, the level of scrutiny applied by the secondary identification method can be lower if the magazine identification shows a match. For example, if a weapon is loaded with an unidentified or incorrectly identified magazine 20, the scrutiny level of the other identification method is increased (e.g., more bits of a voice comparison must match). The result is that, although a shooter who is forced to use a foreign magazine 20 will be able to use the weapon set up for him, shooting will only be permitted after a longer and more precise identification of features peculiar or specific to him. In the process, it could also be necessary for him to wash his hands before using the weapon when his fingerprints or handprints are checked.

If, on the other hand, the magazine 20 exhibits a correct identification code, the other identification methods can be coarsened and, thus, shortened or dispensed with altogether (e.g. fewer bits in an optical iris scan comparison must match to release the weapon for firing).

In some examples, the identifying device 6 includes a microphone 38 (see FIG. 2). In such circumstances, this microphone 38 is used for sound recording (e.g., to prerecord voice commands from an authorized user for later identification/authorization). For example, the microphone 38 may be used to pick up a whistle emitted by a special whistle that belongs to an authorized user of the weapon and whose frequency results in or contributes toward the release of the weapon's safety. A sound sequence from a sound generator can also, similar to a remote-call telephone answering machines, be picked up by the microphone 38 and fed to the evaluation device 6. On the other hand, the microphone 38 can also detect the sound of fired shots such that their number can be recorded in the memory 34. Recording the number of shots may, for example, comprise recording the time of each shot heard by the microphone 38 in the memory 34.

Preferably, the microphone 38 is coupled with a voice and/or a speech (word) recognition device 6. This device 6 recognizes a speaking voice or a spoken word by comparing a speech frequency trend with a pre-stored word or with several pre-stored words from the memory 34. There is already a broad state of the art here, and the problems that result from the presence of strong background noise and the like have been largely solved (for example, in the voice operation of motor vehicles). However, arranging the device 6 together with the microphone 38 exclusively in the handle 2 of a firearm is new.

In a state of emergency the problem with background noises can also be present, for example, shouting, shots etc. However there are additional problems: (a) it may be necessary to only whisper the voice or speech sample (for example, if there are intruders in the house) to release the safety for firing, (b) the excitement during a state of emergency can distort the authorized user's voice, or (c) the user may be hoarse or impaired. In all of these cases the recognition device 6 must reliably release the weapon for authorized users and bar usage for unauthorized users. In some example implementations, these changes in the sound of the user's voice are taken into consideration. For example, words are determined for which the changes in the sound of the voice have only slight effect, further word patterns are saved that have been recorded and stored with screaming, whispering, normal and hoarse voice. In the process, the identification criteria can, if necessary, be coarsened, if an earlier preliminary check (for example, by means of the aforementioned magazine identification system) has been performed.

None of the known voice or speech identification devices take such fluctuations of the sound of the user's voice into consideration.

Preferably, the identification device is adaptive. That is, it adapts to the user's voice, which changes over the course of time, over and over again. With an adaptive device, the user frequently inputs spoken commands to release the safety often during the first couple of days immediately after the purchase of a weapon, whereby one will discover that the recognition device becomes more and more reliable, until it is totally reliable.

As already mentioned earlier, the microphone 38 is preferably provided with a recording device 34, which records at least the last predetermined number of shots; preferably in association with other data such as, for example, the time and/or the identity of the shooter. The recording capacity of the memory 34 can be relatively small, so that only the last couple of dozen shots are recorded. In this way it is possible, for example, to more easily clear up an incident in which shots were fired with the weapon, than previously was the case.

It is also no longer possible for security personnel to use their weapons, (for example, with privately procured ammunition), during a shift outside their official functions for target practice, as previously took place now and then. For after the shift, the recording device 34 can then be routinely read out via the port 36 and, with this information, it could be determined when and who fired shots.

The electronics/electronic equipment can have a timer for identifying the time of the shots. Better yet, a radio-controlled clock, which bridges the radio pauses by means of eigenfunction, but in case of resumed radio communication automatically corrects any errors that have occurred could be employed. The recorded time is, in this case, always correct.

The recording device 34 can also be designed so that all events are stored that can be of importance for the function of the weapon. For example, it is possible to couple the maintenance or the necessary decommissioning of the individual weapon with the history of the weapon much better than was possible previously. For example, if one and the same pistol was always taken from the many automatic pistols of an infantry battalion for practice shooting, then this pistol will be exposed to unusual and unexpected strains. Up to now it has not been possible to determine this unusual usage pattern, so that failures occurred from time to time. With the recording device 34 explained above, the overall load or usage pattern of the weapon can be retrieved at any time, and the weapon can be taken out of commission before material fatigue occurs. To this end, the system of FIG. 7 could be modified so that the memory 44 and the port 46 are located in the housing of the firearm (i.e., not in the magazine 20), and a code uniquely identifying the firearm is stored in the memory 44. As explained above, rather than storing the code in memory 44, other machine-readable codes (e.g., an RF tag, a bar code, etc.) could be employed to identify the weapon.

The described voice and speech recognition system is primarily of importance for weapons of the "weapons used in war," "weapons used in civilian life," and "private defense weapons" categories, which are used in circumstances wherein incidents can arise in which it is necessary to shoot instinctively from the hip, instead of using the provided sight. This is in contrast to the "sporting weapons" category, in which the shooter typically places the weapon in the correct firing position before firing the shot. In this case, the weapon ideally does not have the safety off until it is in the firing position, not only to prevent use by unauthorized persons, but also to avoid security problems in unshouldering and operating the weapon.

For the sporting weapons case, a measuring device for iris recognition may be used. The iris recognition device includes an optical sensor 38 and, if necessary, a small infra-red searchlight. These two elements can also be arranged on top at the rear of the handle 2 on handguns and be aligned in such a way that the optical axes of these devices intersect each other at arm's length behind the weapon and intersect the line of sight.

However, it is also possible to integrate the optical sensor 38 and the infra-red searchlight into one optical sighting mechanism, (for example a telescopic sight), whereby mirrors are used to ensure that all optical axes coincide.

Iris recognition devices have already been developed that are ready for production, (for example, for use in door opening equipment or with check cards or automatic teller machines). Thus, the operation of these devices is well known and will not be explained further herein.

In some examples, the identification device 6 and the preferably electromagnetic actuator 4 of the safety are located in one removable module 1. The module 1 forms a part of the handle 2 and can be exchanged for another module. This approach is of particular importance for users of weapons of the "weapons used in civilian life" category, that is, to users who share a common service weapon. In this case, each user may have his own module 1 and, at the beginning of his shift, he receives a weapon without a module. By inserting his module 1 into the handle 2, this weapon, in a manner of speaking, becomes his own weapon, which only identifies him and only records the shots he fires. This solves the problem of fluctuating personnel, (for example, in the case of unpleasant guard details for whose surveillance the personnel is only assigned in rotation). It is not necessary to reprogram the electronics of the existing weapon for each newly arriving or departing person, since each person has their own electronics in their own module 1. It is also possible to use any of several weapons that are identical in construction with the module 1. Thus, if one weapon requires maintenance or repair, another may be employed in its stead. By virtue of the module 1, any weapon can become a personal weapon assigned to a specified employee.

Of course it is possible to also provide the weapons with identification codes that correspond, for example, to their serial number, and to record the identification code in the module 1 when the module 1 is coupled to the firearm. For example, the serial number of the firearm may be stored in a memory 44 of the weapon and written to the memory 34 of the module 1 whenever the module 1 is connected to the firearm, when a shot is fired, etc. In this way it is possible from the data recorded in the module 1 to infer the individual weapon that a person to whom the module 1 is assigned was carrying at a specific time.

At a minimum, the module 1 controls the safety. The actuator 4 is preferably designed in such a way that the weapon automatically has its safety on after the module 1 has been removed and remains with the safety on until a new module is inserted which activates the weapon after a successful identification/authorization process. The safety can for example be a spring-suspended safety bolt constructed on the weapon, which in its resting position engages the spring guide of the firing-pin spring and locks it. The actuator 4 can be an electromagnet, which is mounted in the module 1 and moves the safety bolt from its resting position if the identification/authorization process was successful.

Additionally it is advantageous to provide a blank module 10, which can be inserted in place of the identification module 1, and which, in the process, releases the safety of the weapon. In this way, it is possible by means of the blank module 10 to produce military weapons of the "weapons used in war" category without having to make any changes to the actual weapon.

It is also possible for a private individual, who, for example, is leaving for a hunting expedition, to equip his weapon beforehand with such a blank module 10 in order to be able to have the weapon ready to fire in case of emergency without performing the identification routine. A home protection weapon which is intended to be used by more than one person can also have a blank module 10, provided it can be ensured that the weapon cannot fall into the hands of unauthorized persons. The manufacturer of such a weapon, which he offers with an identification module 1, can be free from product liability if the customer installs a blank module 10 after purchasing the weapon, but then does not store the weapon safely, so that an unauthorized person causes damage with it.

As used herein the term "blank module" refers to a module that holds a safety in a released condition and to a module that is completely functionless and does not release the safety of the weapon. Thus, the term "blank module" encompasses "safety always off blank modules" as described in the immediately proceeding paragraph, and "safety always on blank modules." With a safety always on blank module 10 it is possible to show weapons in a display window, hand them over to a customer for viewing purposes, or to use them at home as a room decoration. In such cases, stealing of the weapon by unauthorized persons is not ruled out. However, the unauthorized person will not be able to use this weapon because the safety is on and he is unable to release the safety.

An assortment of different modules can be offered, which take into account every intended application of the weapon and all legal requirements. A defective module can, for example, be sent to the manufacturer or to the repair shop for service without having to take safety precautions for its transport. The weapon can be equipped with a new module 1, for example, if in the future further refined identification devices become available, because the basic weapon has the same design. As a result, production is simplified and lower in cost, regardless of how different the interchanged modules might be.

The modules 1 may be structured such that a special tool similar to a key is necessary for their removal, so that the replacement of modules is not easily possible. Strictly restricting distribution of such tools ensures that only each dealer gets such a tool and will not pass it on.

Particularly with handles 2 that do not accept a magazine, such as, for example certain sports pistols, the placement of a module 1 which forms the bottom part of the handle 2 is possible.

However, it is advantageous to have the module 1 form the rear portion of the handle 2. As a result, the module 1 may also form a part of the magazine shaft 22 towards the front (for example, in automatic pistols), so that a magazine identification code can be read and the insertion of the magazine 20 can be used to generate current as explained above. Towards the rear, the module 1 can, if desired, protrude above the hand holding the handle 2 and carry the sensor 38 for iris recognition.

In some examples, a contact sensor 33 is arranged on the rear of the module 1. This contact sensor 33 is coupled with the safety and engages the weapon's safety or even erases the identification data from the memory 34, 44 when the weapon slips from the hand. The weapon is, thus, especially well suited for the "weapons used in civilian life" category. The contact sensor 33 can be a mechanical sensor such as a conventional thumb safety, or it can be an electric/electronic contact sensor.

From the foregoing, persons of ordinary skill in the art will appreciate that a universal and expandable weapon has been provided in which the actual basic model remains practically unchanged, while the safety components can be modified according to the state of the art, according to legal requirements, and/or in accordance with the requirements of the client—even after the weapon has been manufactured and sold.

The modules 1 disclosed above may be used with many types of weapons, but is particularly well suited for use with a weapon with a handle that has an integrated pistol stock, in particular, with a weapon with a single-piece plastic handle. Such a weapon does not give an amateur craftsman the opportunity to get to the mechanism and manipulate it by removing the pistol stocks.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm comprising:

a housing defining a shaft to releasably receive a magazine;

an electronic component located in the housing;

an accumulator to temporarily store energy; and a generator at least partially contained within the housing to supply current to the accumulator in response to movement of a magnet mounted to the magazine, wherein the generator comprises a coil positioned along a periphery of the shaft to generate current in response to insertion or removal of the magnet carried by the magazine into or out of the shaft.

2. A firearm as defined in claim 1, wherein the housing includes a handle, and wherein the magazine is stored in the handle.

3. A firearm as defined in claim 1, wherein the generator further comprises a piezoelectric element positioned such that recoil stress caused by firing of a shot causes the piezoelectric element to generate current.

4. A firearm as defined in claim 1, further comprising:

a safety located in the housing to selectively prevent firing; and a module attachable to the housing and containing an electronic identification device to identify an authorized user, the electronic identification device controlling the safety to prevent firing by unauthorized persons and to permit firing by the authorized user.

5. A firearm as defined in claim 4, further comprising a memory associated with the electronic identification device.

6. A firearm as defined in claim 4, wherein the electronic identification device is powered by the current generated by movement of the magnet of the magazine.

7. A firearm as defined in claim 1, wherein the housing includes a handle, and the magazine is stored in the handle.

8. A firearm as defined in claim 4, further comprising a piezoelectric element positioned in at least one of the housing and the module such that recoil stress caused by firing of a shot causes the piezoelectric element to generate current to at least partially power the electronic identification device.

9. A firearm as defined in claim 8 wherein the recoil stress is a result of movement of a recoil spring, a breech, or a powder-gas driven device.

10. A firearm as defined in claim 4, wherein the magazine further comprises an identification code which is read and recorded by the electronic identification device.

11. A firearm as defined in claim 10 wherein the electronic identification device evaluates the identification code associated with the magazine to identify the authorized user.

12. A firearm as defined in claim 4, further comprising a microphone coupled to the electronic identification device.

13. A firearm as defined in claim 12, wherein the electronic identification device comprises a voice recognition device or a word recognition device.

14. A firearm as defined in claim 13, wherein the voice recognition device is structured to recognize a normal voice, a whisper and a hoarse voice of the authorized user.

15. A firearm as defined in claim 13, wherein the word recognition device is structured to recognize a word spoken in a normal voice, a whisper and a hoarse voice of the authorized user.

16. A firearm as defined in claim 13, wherein the microphone is connected with a memory which records data indicative of spoken commands from the authorized user.

17. A firearm as defined in claim 16, further comprising a timer or time signal receiver, and wherein the data indicative of the spoken commands comprises a firing time.

18. A firearm as defined in claim 12, wherein the microphone is connected with a memory which records data reflecting firing of shots.

19. A firearm as defined in claim 18, further comprising a timer or time signal receiver, and wherein the data reflecting firing of shots comprises a firing time.

20. A firearm as defined in claim 18, wherein more than one user is the authorized user, and the data reflecting firing of shots comprises an identification of the user responsible for the shots.

21. A firearm as defined in claim 5, wherein the memory stores an event indicative of a maintenance requirement of the firearm.

22. A firearm as defined in claim 4, wherein the electronic identification device comprises a sensor for iris recognition, the sensor being directed toward an expected location of an aiming eye of a user attempting to fire the firearm.

23. A firearm as defined in claim 4, wherein the safety prevents firing when the module is removed from the housing.

24. A firearm as defined in claim 4, further comprising a blank module for installation in place of the module.

25. A firearm as defined in claim 24, wherein the blank module is incapable of releasing the safety.

26. A firearm as defined in claim 24, wherein the blank module releases the safety.

27. A firearm as defined in claim 4, further comprising a contact sensor to activate the safety.

28. A firearm as defined in claim 5, wherein the firearm has a firearm identification number and the firearm identification number is written to the memory to record an attachment of the module to the firearm.

* * * * *